US007309106B2

(12) United States Patent
Stallman

(10) Patent No.: US 7,309,106 B2
(45) Date of Patent: Dec. 18, 2007

(54) COOLER WITH SEAT AND ANTI-TIP SUPPORT

(76) Inventor: James J. Stallman, 5084 Lucydale Ave., N. Olmsted, OH (US) 44070

( * ) Notice: Subject to any disclaimer, the term of this patent is extended or adjusted under 35 U.S.C. 154(b) by 0 days.

(21) Appl. No.: 11/420,000

(22) Filed: May 23, 2006

(65) Prior Publication Data

US 2006/0261654 A1 Nov. 23, 2006

Related U.S. Application Data

(60) Provisional application No. 60/683,631, filed on May 23, 2005.

(51) Int. Cl.
*A47C 13/00* (2006.01)

(52) U.S. Cl. ..... 297/310; 297/217.1; 297/188.9; 312/235.7

(58) Field of Classification Search ..... 297/188.1, 297/188.9, 217.1, 310; 312/235.2–235.8; 43/54.1; 206/315.11; 62/372, 457.1
See application file for complete search history.

(56) References Cited

U.S. PATENT DOCUMENTS

| | | | | | |
|---|---|---|---|---|---|
| 323,610 | A | * | 8/1885 | Van Wie | 248/188.1 |
| 361,882 | A | | 4/1887 | Luft | |
| 1,156,367 | A | | 10/1915 | Masler | |
| 1,673,988 | A | | 6/1928 | Nitti | |
| 2,423,659 | A | * | 7/1947 | Rabe | 248/188.9 |
| 2,493,084 | A | | 1/1950 | Pharo | |
| 2,812,227 | A | | 11/1957 | Hill | |
| 2,919,169 | A | | 12/1959 | Jackson | |
| 2,941,579 | A | * | 6/1960 | Barker | 297/310 |
| 3,077,327 | A | | 2/1963 | Batie et al. | |
| 3,145,646 | A | | 8/1964 | Levy | |
| 3,230,006 | A | | 1/1966 | Sokolis | |
| 4,067,607 | A | | 1/1978 | Battles | |
| 4,228,894 | A | | 10/1980 | Lyles | |
| 4,353,182 | A | | 10/1982 | Junkas et al. | |
| 4,474,407 | A | | 10/1984 | Nazar | |
| 4,541,539 | A | | 9/1985 | Matthews | |
| 4,883,317 | A | | 11/1989 | Davenport | |
| 5,100,198 | A | | 3/1992 | Baltzell | |
| 5,269,157 | A | * | 12/1993 | Ciminelli et al. | 62/457.7 |
| 5,435,642 | A | | 7/1995 | Kennedy | |
| 5,435,643 | A | | 7/1995 | Kennedy | |
| 5,595,429 | A | | 1/1997 | Kennedy | |
| 5,622,404 | A | | 4/1997 | Menne | |
| 5,692,335 | A | | 12/1997 | Magnuson | |
| 5,727,844 | A | * | 3/1998 | O'Quinn et al. | 297/217.1 |
| 5,882,070 | A | | 3/1999 | Genn | |
| 6,283,544 | B1 | | 9/2001 | Alcala et al. | |
| 6,341,817 | B1 | * | 1/2002 | Stern-Gonzalez | 297/188.1 |
| 6,502,900 | B1 | | 1/2003 | Johnston | |
| 6,520,609 | B1 | | 2/2003 | Beauregard et al. | |
| 6,712,711 | B1 | | 3/2004 | Skelton et al. | |
| 6,733,073 | B2 | | 5/2004 | Whiteside et al. | |
| 2002/0084731 | A1 | | 7/2002 | Konishi | |
| 2003/0141789 | A1 | | 7/2003 | Gorelick | |
| 2004/0160147 | A1 | | 8/2004 | Bochner | |

* cited by examiner

*Primary Examiner*—Peter R. Brown
(74) *Attorney, Agent, or Firm*—Dwight A. Stauffer, Patent Agency

(57) ABSTRACT

A combined cooler/seat having an anti-tip support that extends rearward the ground contact of the cooler/seat beyond the simple footprint of the cooler/seat itself, thereby providing extra support for resisting backward tilting of the cooler/seat; wherein the anti-tip support adjustably extends rearward from the bottom rear portion of the cooler/seat.

7 Claims, 9 Drawing Sheets

COOLER WITH SEAT AND ANTI-TIP SUPPORT

CROSS-REFERENCE TO RELATED APPLICATIONS

This application claims the benefit of U.S. Provisional Patent Application No. 60/683,631, filed May 23, 2005 by James J. Stallman.

TECHNICAL FIELD OF THE INVENTION

The present invention relates to portable cool storage devices and, more particularly to said storage devices combined with seating.

BACKGROUND OF THE INVENTION

The well-known basic portable "cooler" includes an insulated chamber for containing ice and/or items to be kept cold, and has carrying handles and/or other known provisions for portability such as wheels, for example.

The prior art includes many varieties of a storage compartment that also functions as a chair, with or without a seatback. In the instances wherein a collapsible (e.g., folding) support is provided to prevent tipping of the seat, the anti-tipping support generally appears as some form of rear chair leg(s) that pivots rearward about an elevated pivot. Examples can be seen in U.S. Pat. Nos. 3,077,327 and 2,493,084.

Various enhancements have been added to coolers in order to customize them for specific uses. For example, U.S. Pat. No. 3,230,006 (Sokolis; 1966) discloses a foldable fisherman's chair (10) which is provided with an integral refrigerated storage compartment (20) and a tackle box (40). The compartment has front (12) and rear (16) bottom pieces for resting on the ground, and a hinged top compartment cover (25) that also constitutes a padded seat for the fisherman. The compartment is a single receptacle that serves as a chest which may contain ice for the refrigeration of fish, or bait, or any other desired material, such as cold drinks. The tackle box is a sliding drawer secured below the compartment. Both the compartment cover and the tackle box have means (35, 61) for latching them in a closed position. A seat back is provided by pivotably attaching a U-shaped back member (67) to the sides of the compartment. The back member is supported by a U-shaped leg frame (85) that is pivotably connected to the back member such that a back leg bottom piece (87) can be positioned to rest on the ground behind the compartment. Links (90) are connected by pivots (91, 92) to the lower portions of the compartment rear frame and the leg frame. The Sokolis FIGS. 5 and 6 show two different positions for folding the combined seat back and leg frame into a more compact configuration for carrying and storage. Both configurations remove the back leg bottom piece (87) from ground contact: the first by pivoting the leg frame and back member upward and toward the compartment such that the back member extends upward from the compartment; the second by pivoting the leg frame and back member downward and toward the compartment such that the back member extends rearward from the compartment.

Somewhat related, but more compact, is a portable chair with an insulated seat cooler that is disclosed in U.S. Pat. No. 4,474,407 (Nazar; 1984). The chair has a hollow seat base (1) with a hinged front access door (4) having a lock (5). The hollow portion is thermally insulated for keeping perishable foodstuffs, canned or bottled beverages, ice, fishing bait, or the like. The seat top (14) is contoured and/or padded with insulation 8 for seating comfort. A back member (2) is hingedly secured to the seat base whereby the back rest (2) may extend upward and back from the seat top for use, or may be folded upon the top of the seat for compact storage. A U-shaped back member support prop (3) of tubular construction may be hingedly secured to the back member whereby the support prop may extend back from the seat portion for greater reclining and comfort and additionally to prevent tipping of the device when occupied, or may be folded upon the lower rear portion of the back support member to become a convenient handle for carrying the collapsed portable chair/cooler.

It is an object of the present invention to overcome limitations of the prior art, such as the cumbersome form of the Sokolis device even when collapsed; and such as the limited usefulness of the Nazar device. Thus it is an object to provide a combined cooler and chair that provides all of the advantages of both, including a full size, full function cooler and one or two comfortable seat(s) with seat back(s) and an anti-tip support, all of which collapse into the profile of the cooler, thereby enabling convenient mobility and portability.

BRIEF SUMMARY OF THE INVENTION

The well-known basic portable "cooler" comprises an insulated chamber for containing ice and/or items to be kept cold, and has carrying handles and/or other known provisions for portability such as wheels, for example. The inventive cooler includes a variety of augmentations of the basic cooler, such that the inventive cooler can be used as a portable seat with provisions for storage and/or holding of items related to an activity of the user. For example, a preferred embodiment of the invention comprises a fisherman's cooler with a padded seat (or two); separate cooler compartments for food/drink, and fish and/or bait; a tackle storage drawer, a retractable fishing pole holder, a fold-up cup/can holder, etc.

The top of the inventive cooler is cushioned and/or molded plastic such that one or two users can sit on the seat(s) with legs extending down in front of the front long side of the cooler. Access to the cooler compartments (e.g., cold storage, tackle drawer) is from the front side as shown in the accompanying illustrations of preferred embodiments.

Preferably there is a seat back (backrest) that, for example, folds up to a suitable approximately vertical angle, for example hinged at the top edge of the back long side of the cooler. Many other seat back implementations are possible, including for example, a seat back: that is fixed in place, that slides upward along the back side of the cooler, that is fabric between two poles that removably fit in vertical holes or brackets at the back of the cooler, etc.

An important feature of the inventive cooler is an anti-tip support that extends rearward the ground contact of the cooler beyond the simple footprint of the cooler itself; thereby providing extra stability, i.e., extra support for resisting backward tilting of the cooler in response, for example, to a user sitting on the cooler seat and leaning back against the seat back.

The distinguishing aspect of the cooler's inventive anti-tip support is that it adjustably extends rearward from the bottom edge of the rear long side of the cooler, preferably substantially in the same plane as the bottom surface of the cooler.

The anti-tip support can be a solid planar surface, but is preferably a support bar that is substantially parallel to the bottom rear long edge of the cooler, and adjustably offset rearward from that edge. The support bar is held in its offset position by one or more extension bars that extend between the support bar and the bottom rear long edge of the cooler.

The preferred embodiment of the anti-tip support bar is a round semi-rigid tube in a squared-off U shape such that two extension bars are the sides of the U shape, and the support bar is the squared-off "bottom" of the U shape. An alternate embodiment (not illustrated) is a T shaped bar where a single extension bar is the vertical stem of the T shape.

The preferred embodiment is shown with the extension bars sliding in and out of tubing guides built into the bottom of the cooler. If the bars are rigid enough (e.g., aluminum or thick walled PVC plastic) then the support bar will be held substantially in the plane of the bottom by cantilever forces between the extension bars and the tubing guides.

Some amount of flexibility may be included in the extension bar(s) and/or the support bar in order to allow the anti-tip support to adapt to somewhat uneven ground.

Optional alternate embodiments include ancillary braces such as, for example: a slide-a-way bar, or a flip-out triangular support.

Although not illustrated, another alternate embodiment is an anti-tip support that is hinged at the bottom rear long edge of the cooler such that it can swing downward from the back side, or upward from the bottom side, and be braced at the desired position (e.g., in the plane of the cooler bottom) by ancillary braces such as those described above.

Other objects, features and advantages of the invention will become apparent in light of the following description thereof.

BRIEF DESCRIPTION OF THE DRAWINGS

Reference will be made in detail to preferred embodiments of the invention, examples of which are illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

Certain elements in selected ones of the drawings may be illustrated not-to-scale, for illustrative clarity. The cross-sectional views, if any, presented herein may be in the form of "slices", or "near-sighted" cross-sectional views, omitting certain background lines which would otherwise be visible in a true cross-sectional view, for illustrative clarity.

Elements of the figures can be numbered such that similar (including identical) elements may be referred to with similar numbers in a single drawing. For example, each of a plurality of elements collectively referred to as 199 may be referred to individually as 199*a*, 199*b*, 199*c*, etc. Or, related but modified elements may have the same number but are distinguished by primes. For example, 109, 109', and 109" are three different elements which are similar or related in some way, but have significant modifications. Such relationships, if any, between similar elements in the same or different figures will become apparent throughout the specification, including, if applicable, in the claims and abstract.

Figure 2:
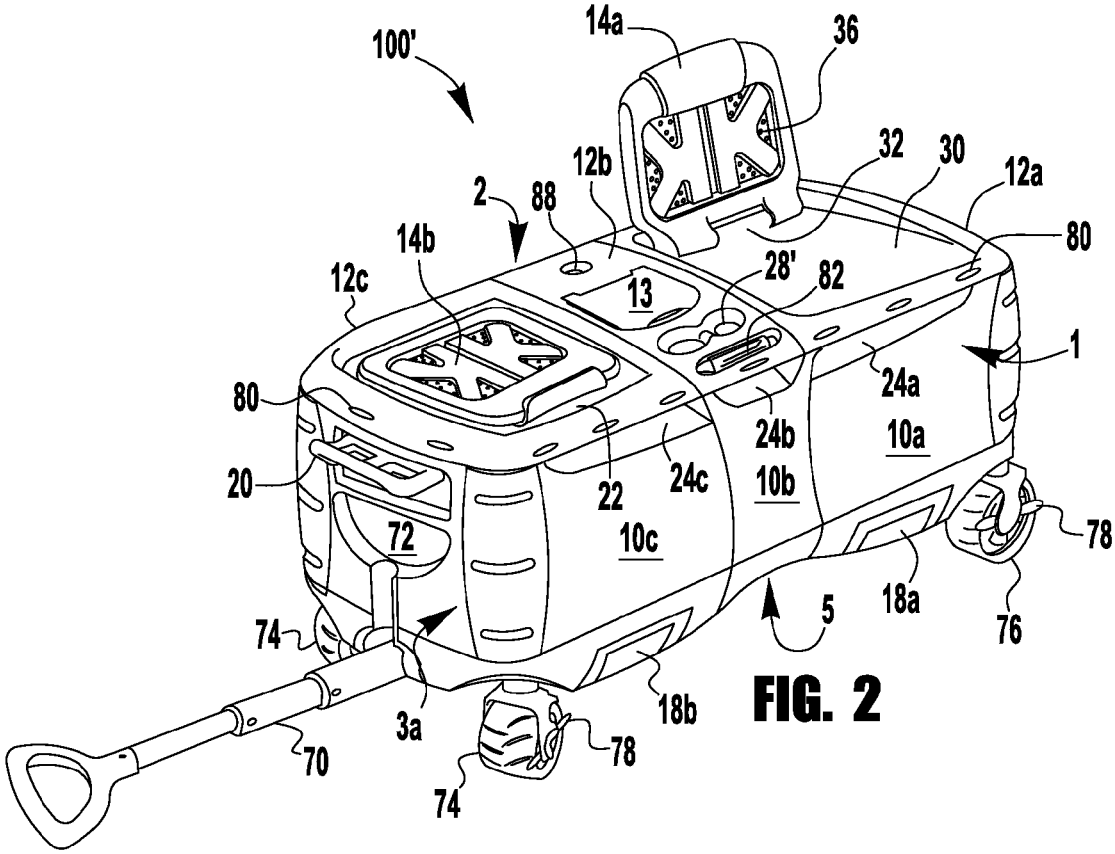
Figure 3:
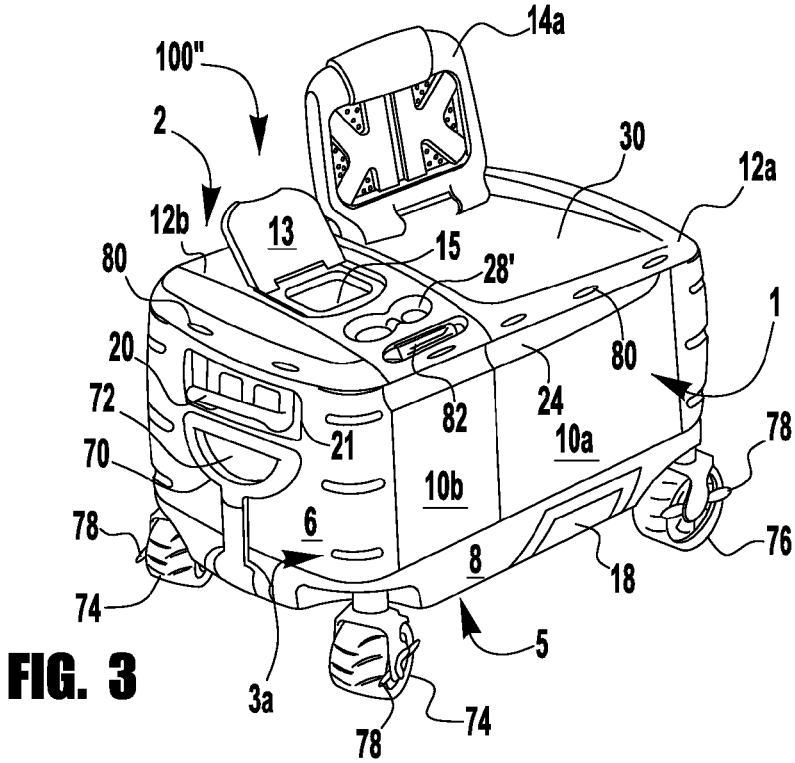
Figure 4:
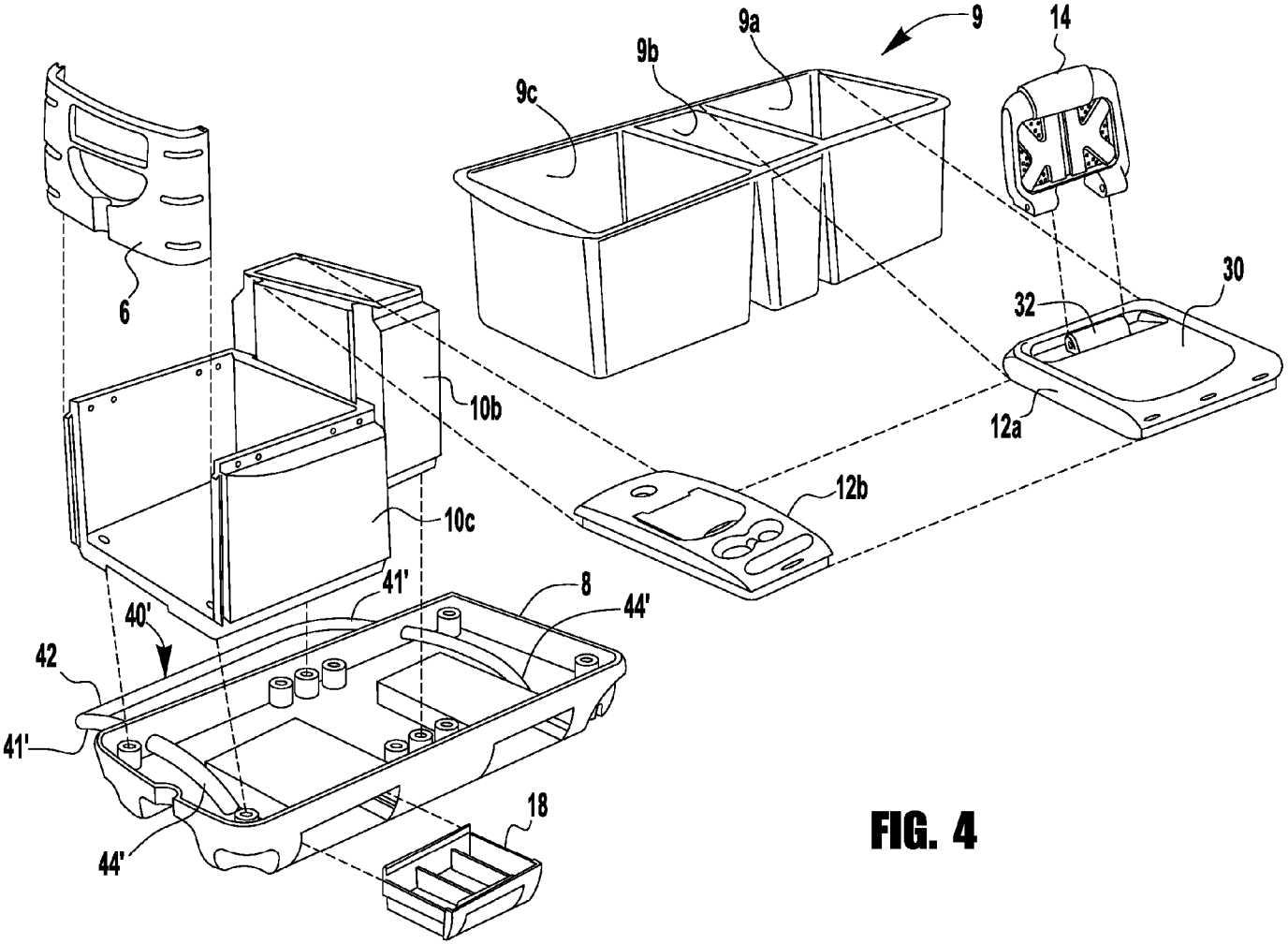
Figure 5:
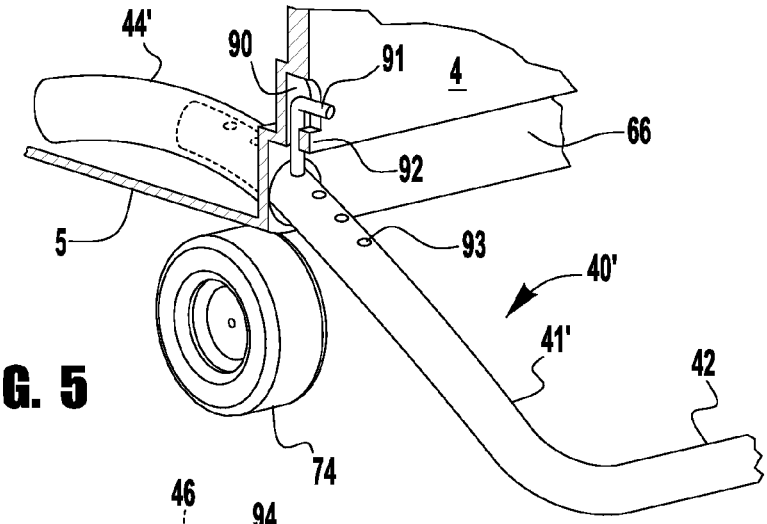
Figure 6A:
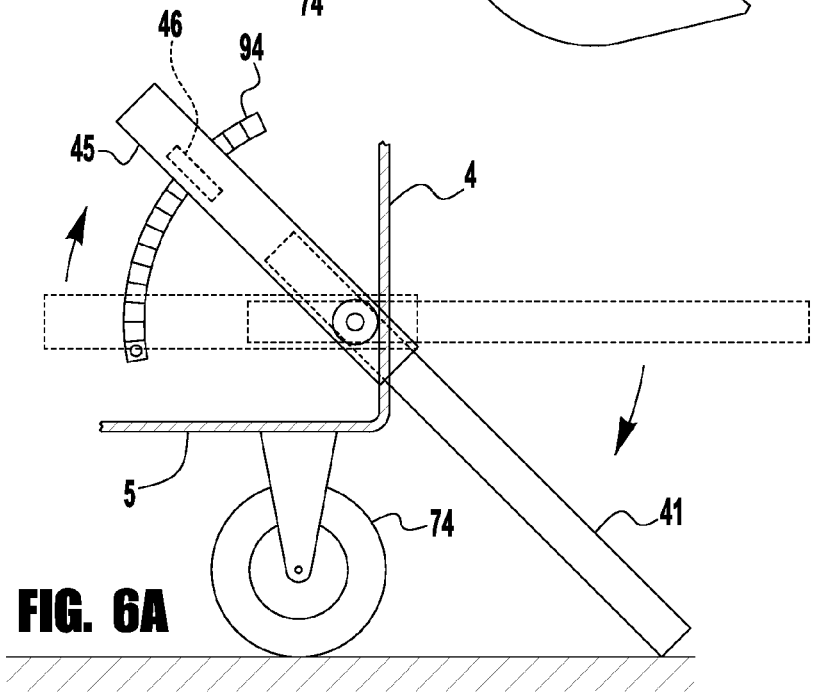
Figure 6B:
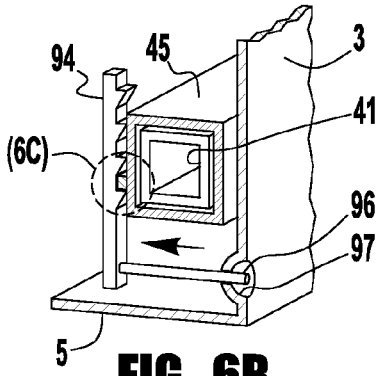
Figure 6C:
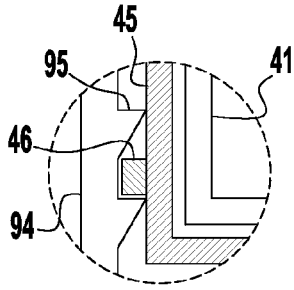
Figure 7:
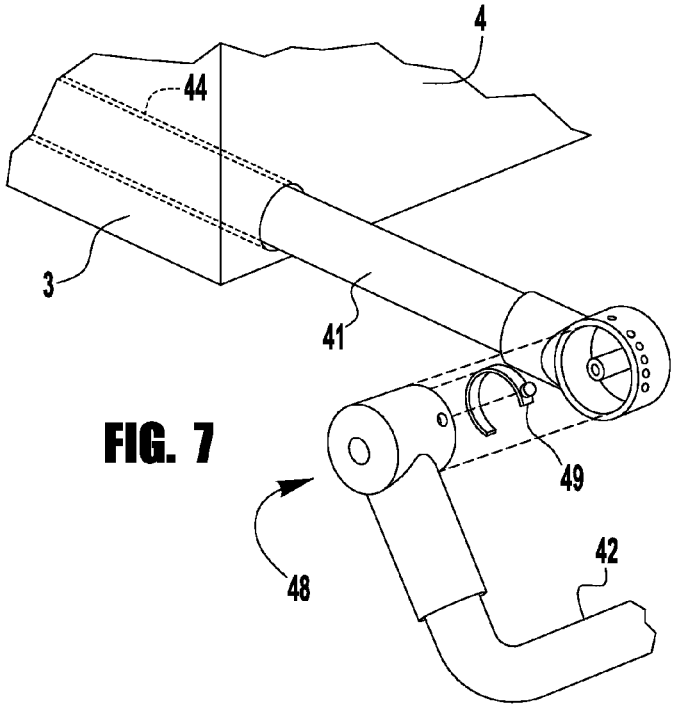
Figure 8A:
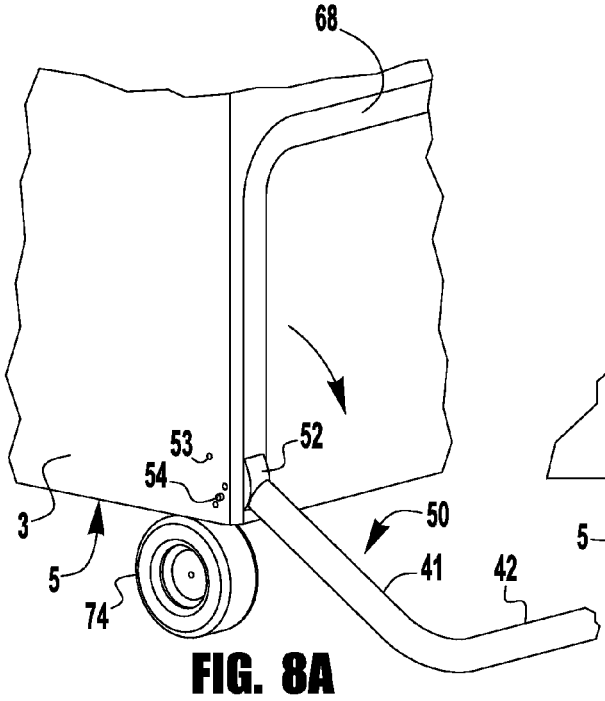
Figure 8B:
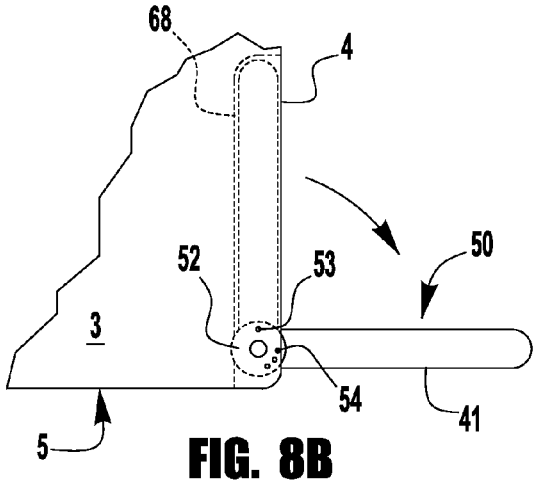
Figure 9:
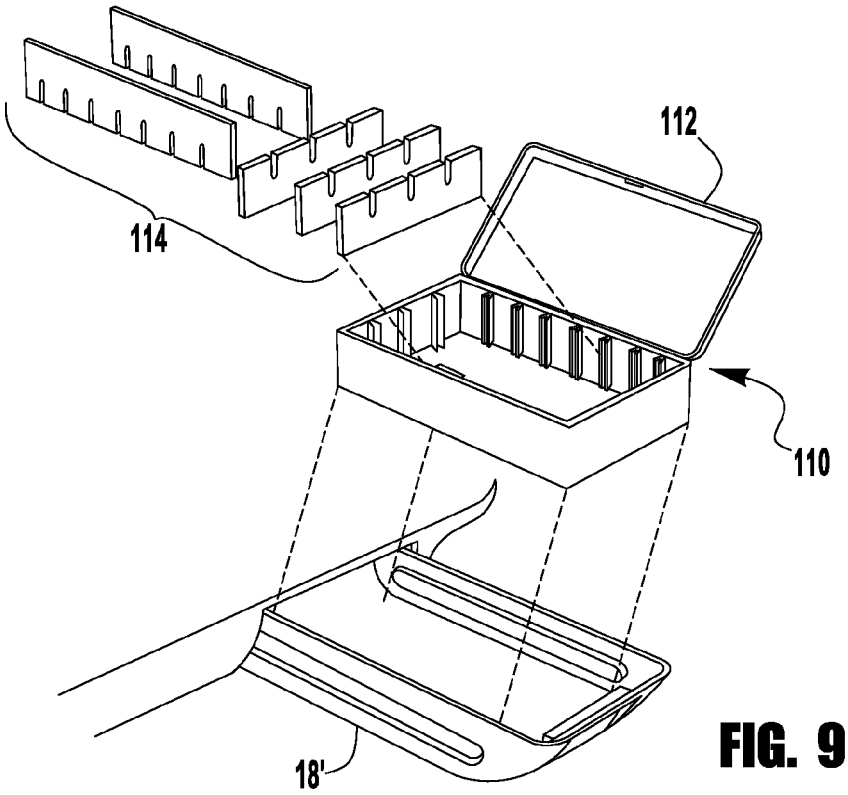
Figure 10:
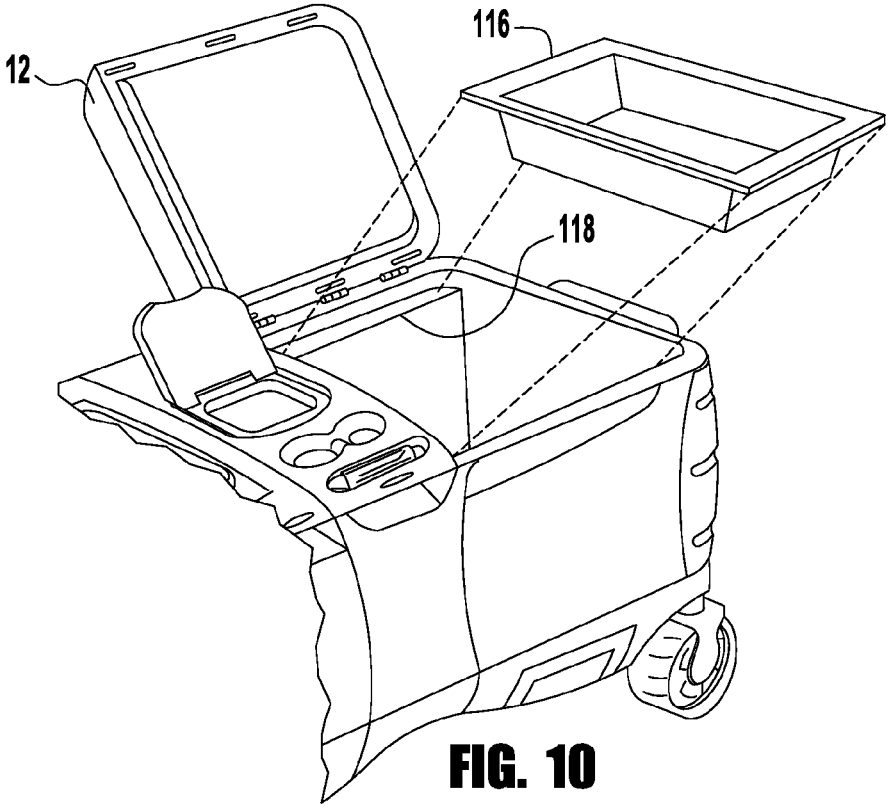
Figure 11:
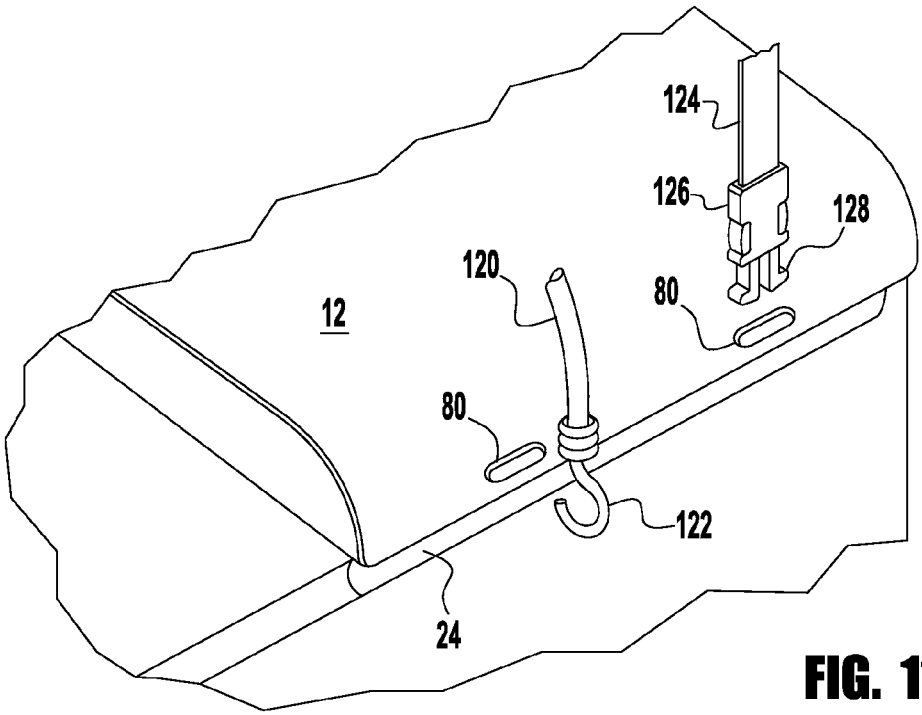
Figure 12:
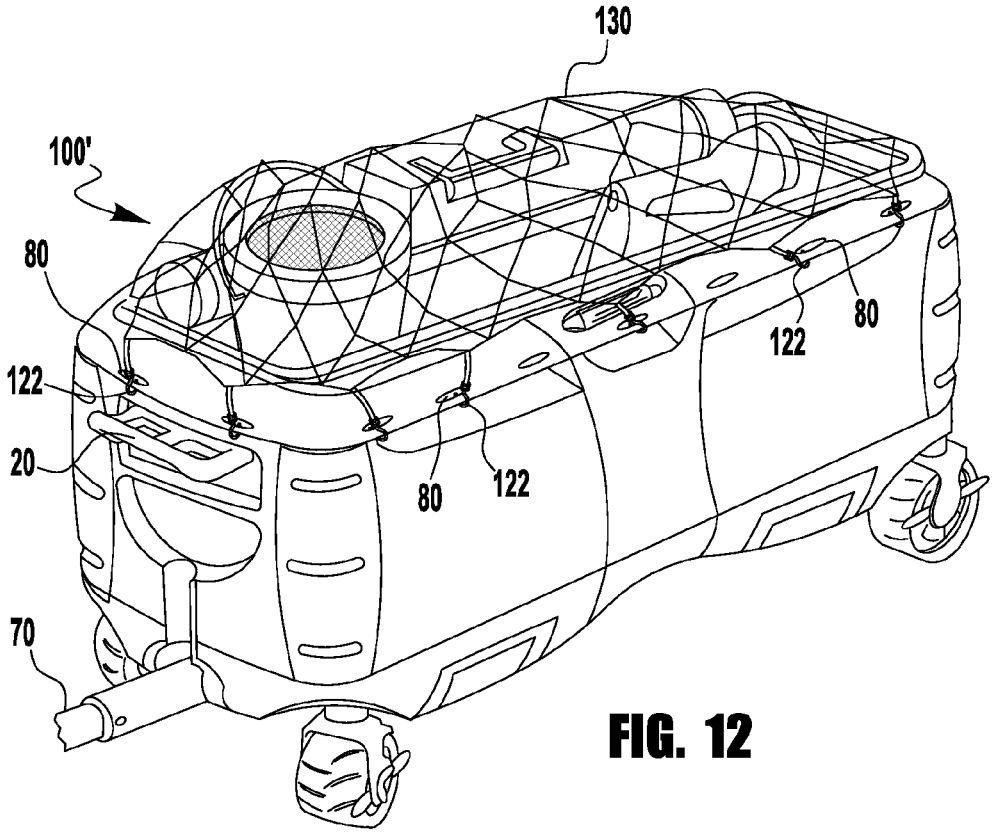
Figure 13A:
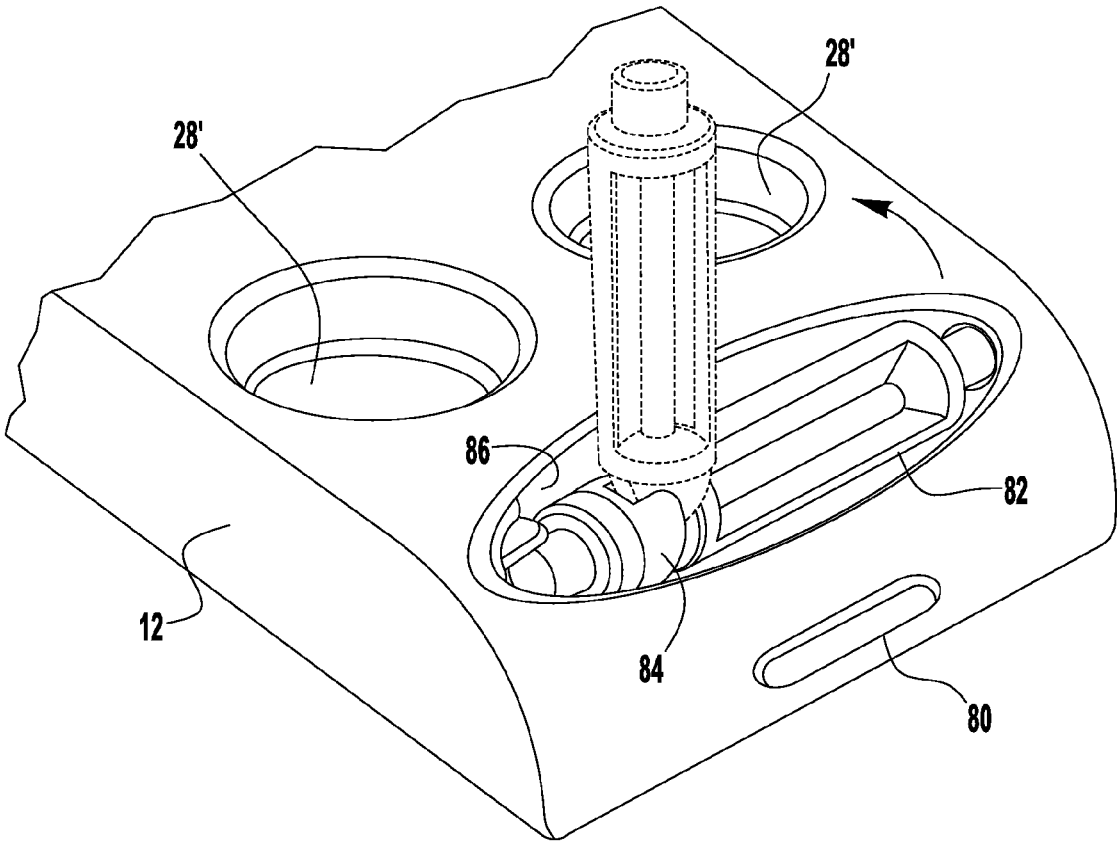
Figure 13B:
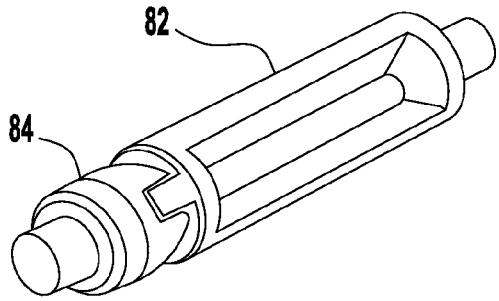

The structure, operation, and advantages of the present preferred embodiment of the invention will become further apparent upon consideration of the following description taken in conjunction with the accompanying drawings, wherein:

FIGS. 1A-1D are perspective views of a combined cooler and seat according to the invention;

FIGS. 2-3 are perspective views of two exemplary finished-design embodiments of the inventive cooler/seat; FIG. 2 being a two person cooler/seat and FIG. 3 being a one person cooler/seat, both according to the invention;

FIG. 4 is a perspective exploded view of a modular version of a two-seated cooler/seat according to the invention;

FIG. 5 is a perspective view, with a side wall of the cooler cut off, of a curved sleeve with a curved leg of a sliding embodiment of an anti-tip support for the inventive cooler/seat according to the invention;

FIGS. 6A-6C are, respectively, a side view, a perspective end view, and a magnified cutout view of the area marked (6C) in FIG. 6B, of a pivoting sleeve with sliding leg embodiment of the anti-tip support according to the invention;

FIG. 7 is a perspective exploded view of a sleeve with a sliding leg having a pivot knuckle embodiment of the anti-tip support according to the invention;

FIGS. 8A-8B are, respectively, a perspective view and a side view of a bottom back edge pivoted embodiment of the anti-tip support according to the invention;

FIG. 9 is a perspective exploded view of a storage drawer that is adapted for tackle storage with a removable tackle box, the storage drawer being part of an embodiment of the inventive cooler/seat according to the invention;

FIG. 10 is a perspective exploded view of an optional top tray supported by ledges inside a cooler compartment of an embodiment of the inventive cooler/seat according to the invention;

FIG. 11 is a partial perspective view of a rope/cord/strap with exemplary removable attachments to tie-down holes in an embodiment of the inventive cooler/seat according to the invention;

FIG. 12 is a perspective view of a cargo net shown hooked onto an embodiment of the inventive cooler/seat for holding items according to the invention; and FIGS. 13A-13B show a flashlight being stored in a recess of an embodiment of the inventive cooler/seat, and also shows exemplary ways for using the flashlight, all according to the invention.

DETAILED DESCRIPTION OF THE INVENTION

The inventive cooler/seat combination 100, 100', 100" includes a variety of augmentations of a basic cooler, such that the inventive cooler 100, 100', 100" can be used as a portable seat 30 with provisions for storage and/or holding of items related to an activity of the user. For example, an embodiment of the invention comprises a fisherman's cooler 100 with a padded seat (or two) 30; separate cooler compartments 9*a*, 9*b*, 9*c* for food, drinks, and for fish and/or bait; a tackle storage drawer 18, a retractable fishing pole holder 26, a cup/can holder 28, etc.

Referring now to FIGS. 1A, 1B, 1C and 1D the basic concepts of the inventive cooler/seat 100, 100', 100" are shown schematically in a simplified cooler/seat 100 embodiment. The several sides of the cooler 100 are illustrated including a front 1, top 2, ends 3 (collectively referring to a left end 3*a* and a right end 3*b*), back 4, and bottom 5. The top 2 of the cooler 100 is a two layered construction with both layers having hinges 32, 38 at the back 4. The uppermost layer is a fold-up backrest 14 (seatback), best viewed in FIG. 1B. A gripping recess 22 in the front 1 edge of the backrest 14 provides a means for lifting and folding up the backrest 14. Support cords 34 on either end 3*a*, 3*b* prevent the backrest 14 from leaning back too far. The backrest 14 is optionally ventilated by perforated or screened in areas 36. The next layer of the cooler top 2 is the actual cooler lid 12 which may be held closed by latches 16, and finger access for raising the lid 12 is provided by a lid gripping recess 24. The top 2 of the cooler lid 12 shaped and/or padded (as shown) for providing at least one comfortable seat 30. Two seats 30 are shown side by side for the illustrated large size cooler/seat 100.

Most of the cooler/seat 100 is a main body 10 that surrounds one or more cooling compartments (e.g., compartments 9*a*, 9*b*, 9*c* shown in FIG. 4) with a shell of thermally insulated walls. Carrying handles 20 are recessed in each end 3. A variety of special features are optionally provided, such as a storage drawer 18 that slides into the bottom 5 of the front wall 1 and may have a latch 17. The storage drawer 18 can be used to hold fishing tackle that is conveniently accessed by a user seated on the cooler/seat 100. In either or both ends 3 a fold-down cup holder 28 and a retractable fishing pole holder 26 can be provided. When in a stored position, either holder 28, 26 can be finger gripped in recesses 27. The cup holder 28 folds down around a supporting hinge 31. The pole holder 26 slides out to reveal a tubular cavity 29 for receiving the handle of a fishing pole, and is tilted forward at a convenient angle for fishing.

Obviously the backrest 14 can be implemented in a wide variety of forms that are simple variants of the illustrated design wherein the backrest 14 is primarily attached to the top 2 back 4 edge of the cooler/seat 100. This design will tend to cause the cooler/seat 100 to tip over (tilt) backwards in response to a seated user who leans back against the backrest 14. Thus an important feature of the inventive cooler/seat 100, 100', 100" is an anti-tip support (e.g., 40) that extends rearward the ground contact of the cooler/seat 100, 100', 100" beyond the simple footprint of the cooler/seat 100, 100', 100" itself, thereby providing extra stability, i.e., extra support for resisting backward tilting of the cooler/seat 100, 100', 100".

The distinguishing aspect of the inventive anti-tip support (e.g., 40) is that it adjustably extends rearward from the bottom 5 rear 4 portion of the cooler/seat 100, 100', 100".

Figure 1A:
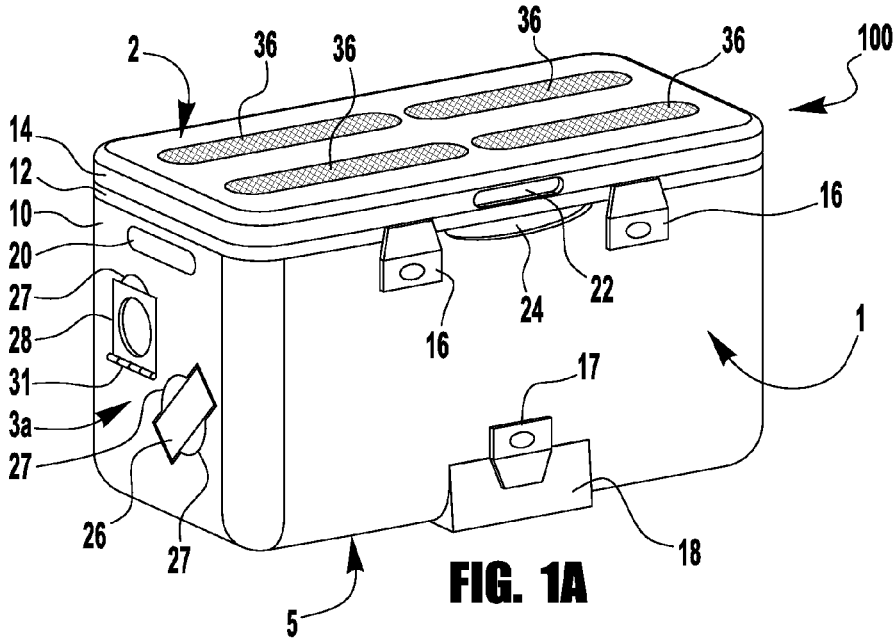
Figure 1B:
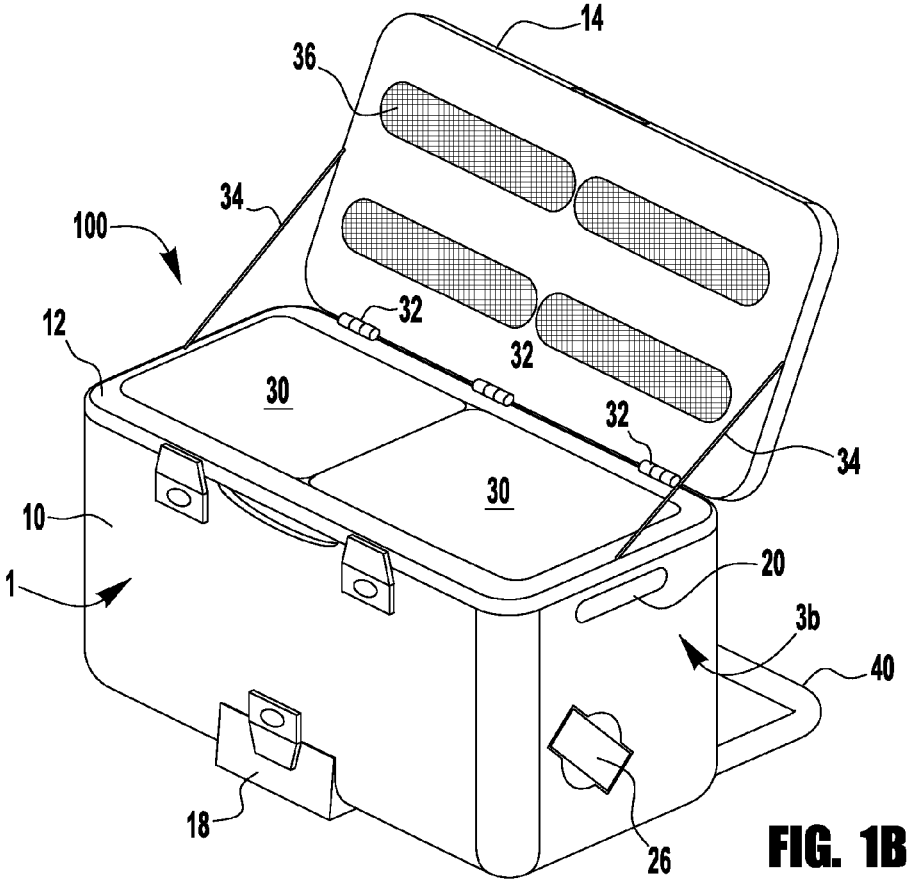
Figure 1C:
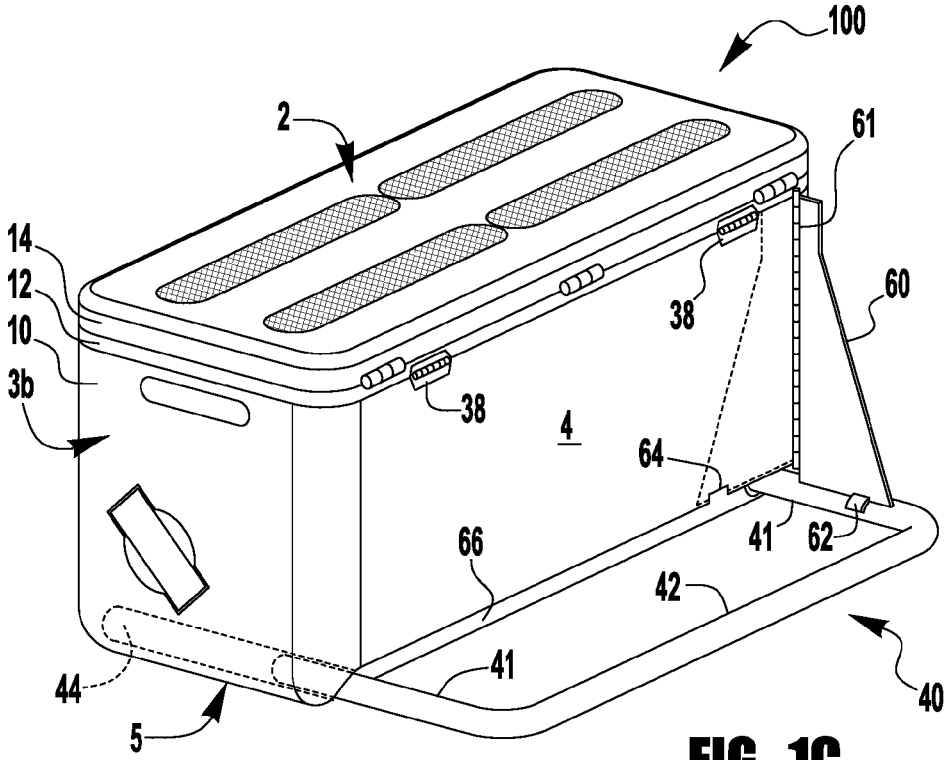
Figure 1D:
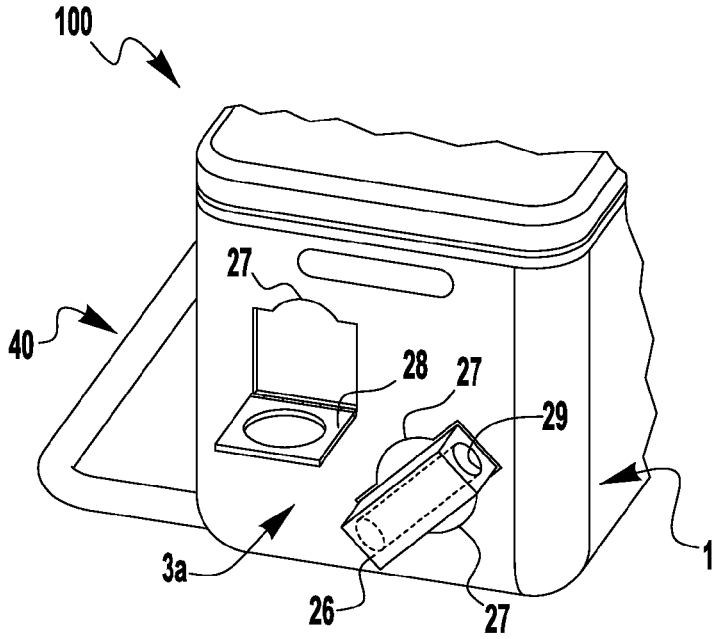

The anti-tip support (e.g., 40) can be a solid planar surface, but is preferably a square-U shaped bar having a foot 42 and legs 41 extending from the back 4 of the cooler/seat 100, 100', 100" to the foot 42. The anti-tip support 40 that is shown in FIGS. 1B-1D has straight legs 41 that slide in and out of the cooler/seat 100, 100', 100" within sleeves 44 which, in this example, are parallel to the bottom 5 and therefore also to the ground (as long as the ground is level). As shown in FIG. 1C, when fully extended rearward, a portion of each leg 41 remains in the sleeve 44 thereby providing a cantilever force for resisting tipping of the cooler/seat 100, 100', 100". When fully retracted, the anti-tip support 40 is stored in the sleeves 44 and in a storage recess 66. An optional gusset 60 (shown on one side only for illustrative purposes) may be foldingly attached to the back wall 4 by a hinge 61 and can be either folded rearward to lie along the top of the leg 41 or be stored folded flat against the back wall 4 (optionally recessed). A clip tab 62 helps hold the gusset 60 in position on the leg 41 or snaps into a tab slot 64 to hold the gusset 60 against the cooler back 4.

Some amount of flexibility may be included in the legs 41 and/or the foot 42 in order to allow the anti-tip support 40 to adapt to somewhat uneven ground. Other embodiments of the inventive anti-tip support (e.g., 40) will be presented hereinbelow in conjunction with other embodiments of the cooler/seat 100, 100', 100".

FIGS. 2 and 3 illustrate two more formally designed embodiments of the inventive cooler/seat 100, 100', 100"; FIG. 2 being a large two person cooler/seat 100' embodiment that also exhibits fancy curved edges and profiles; FIG. 3 being a smaller one person cooler/seat 100" embodiment that exhibits straight-line joining edges where they will make modular construction simpler to implement as will be seen in FIG. 4. The two embodiments share most other characteristics and features.

The body 10 of each is segmented into one or two large compartment portions topped by seats 30 that are here shown as molded plastic, and a narrow console portion 10*b*. Each seat 30 has its own seatback 14*a*, 14*b*, perforated 36 for ventilation, and having a molded hinge 32 with a shape that limits its opening angle. A storage drawer 18 (18*a*, 18*b*) is provided at the bottom 5 of each large body portion 10*a*, 10*c*. The lid gripping recess 24 can be either continuous along the top 2 front 1 edge or may be compartmented (24*a*, 24*b*, 24*c*). The cooler lid 12 is segmented to correspond to the body segments: 12*a* on 10*a*, 12*b* on 10*b*, and 12*c* on 10*c*. As shown in FIGS. 4 and 10, there are thus separately opening cooler lids 12*a*, 12*b*, 12*c* covering corresponding separate cooling compartments 9*a*, 9*b*, 9*c*. Around the outside edge of the cooler lids 12 several spaced apart tie-down holes 80 are provided. The narrower console portion has several features built into its cooler lid 12*b*. There is a pole or umbrella socket 88, a pair of recessed can/cup holders 28', and an adjustable/removable flashlight 82. A hatch cover 13 is a hinged lid that covers a hatchway 15 that is large enough to allow convenient reaching into the console cooling compartment 9*b*/10*b*. The hatchway 15 can be used to extract beverage containers, store used containers and trash, or to access live fishing bait. Of course for larger object handling the entire console lid 12*b* may be raised.

The carrying handles 20 are hinged and fold into a storage recess 21, but a significant extra feature is the provision of wheels 74, 76 and a telescoping pull handle 70 that can be stored in its own recess 72. Preferably the wheels 74 at the pull handle (left) end 3*b* are swiveling casters, while the wheels 76 at the opposite end are non-swiveling casters. Also preferably, two or more of the wheels 74, 76 have wheel locks 78 that prevent the wheeled cooler/seats 100', 100" from moving when a user is sitting on them.

FIG. 4 shows a modular version of the double wheeled cooler/seat 100', having a one piece base 8, modular insulated compartment body portions 10*b*, 10*c* and an insulated end cap 6, all of which interlock for easy assembly. A one piece molded plastic compartmented cooler liner 9 drops down into the assembled body.

The base 8 also shows a curved sleeve 44' with a curved-leg 41' anti-tip support 40'. FIG. 5 shows another view of this and illustrates how the curved sliding anti-tip support 40' is able to adjustably slide down and rearward to rest the foot 42 on the ground when the wheeled cooler/seat 100', 100" is raised up on wheels. A latchpin 91 sliding in a latch channel 90, 92 can be inserted into a selected latch hole 93 to lock the curved sliding anti-tip support 40' in place for adequate anti-tip support regardless of what may be a varying height ground surface.

FIGS. 6A-6C illustrate another support that accomplishes these objectives. The leg 41 still slides in a sleeve 45 (both square tubing in this embodiment) which provides cantilever support, but the sleeve 45 pivots at the bottom 5 back 4 edge by an angular amount that is adjustable by means of a ratchet rack 94 mounted in the cooler and a ratchet cog 46 affixed to the pivoting sleeve 45. Since the ratchet teeth 95 are cammed upward, a simple downward push on the leg 41 will ratchet the sleeve 45 upward until the leg 41 and foot (not shown) touch the ground. To raise the leg 41 the ratchet rack 94 must be pushed away from the ratchet cog 46 by a ratchet release pushrod 96 that is pushed into a finger recess 97. The ratchet rack 94 is spring biased toward the ratchet cog 46.

FIG. 7 illustrates another support that accomplishes these objectives. The leg 41 still slides rearward in a straight sleeve 44 which provides cantilever support, but the foot 42 is mounted on pivot knuckle 48 that, for example, uses a spring-button 49 to latch the knuckle 48 at a desired pivot angle for placing the foot 42 firmly on the ground.

FIGS. 8A-8B illustrate another support that accomplishes these objectives. Instead of sliding in a sleeve, this is a bottom 5 back 4 edge pivoted anti-tip support 50. The pivot 52 rotates the leg 41 and foot 42 out of a storage recess 68 and both downward and rearward toward the ground behind the cooler/seat 100, 100', 100" (which may or may not be wheeled). The pivot angle is selectable in order to provide anti-tip support on uneven ground and/or below a raised wheeled cooler/seat 100', 100". Selection is accomplished by a spring button 54 which pops into selected pivot latch holes 53.

FIG. 9 shows how an uncompartmented storage drawer 18' can be adapted for tackle storage with a removable tackle box 110, optionally with a hinged lid 112, and compartmented with movable partitions 114.

FIG. 10 shows how an optional top tray 116 can be supported by ledges 118 inside the cooler compartment.

FIG. 11 shows two ways that the tie down holes 80 can be utilized to tie luggage down onto the top of the cooler lid 12. A hook 122 on a rope or shock cord 120 can be hooked through the lid gripping recess 24 and up through the tie down hole 80. Alternatively a snap buckle 126 on a strap 124 can have its latch tabs 128 snapped into the tie down hole 80 which is purposely shaped to accommodate such a snap buckle 126. In FIG. 12 a cargo net 130 is shown hooked onto the top of a wheeled cooler/seat 100', 100" for holding items while it is pulled by the pull handle 70, or carried by the handles 20.

Finally FIGS. 13A-13B show that a flashlight 82 can be stored in a recess 86, pivoted upward on a pivot joint 84, or popped out of the recess 86 for hand held use.

Although the invention has been illustrated and described in detail in the drawings and foregoing description, the same is to be considered as illustrative and not restrictive in character—it being understood that only preferred embodiments have been shown and described, and that all changes and modifications that come within the spirit of the invention are desired to be protected. Undoubtedly, many other "variations" on the "themes" set forth hereinabove will occur to one having ordinary skill in the art to which the present invention most nearly pertains, and such variations are intended to be within the scope of the invention, as disclosed herein.

What is claimed is:

1. A combined cooler/seat comprising:

an anti-tip support that extends rearward the ground contact of the cooler/seat beyond the simple footprint of the cooler/seat itself; thereby providing extra support for resisting backward tilting of the cooler/seat;

wherein the anti-tip support adjustably extends rearward from the bottom rear portion of the cooler/seat; and the anti-tip support is a square-U shaped bar having a foot and legs adjustably extending from a back of the cooler/seat to the foot, the legs adjustably sliding in and out of the cooler/seat within sleeves that are built into a bottom portion of the cooler.

2. The cooler/seat of claim 1, further comprising:

A gusset that is foldingly attached to the back such that it hingedly folds rearward to lie along the top of the leg for added support.

3. The cooler/seat of claim 1, further comprising:

wheels that raise the entire bottom portion of the cooler/seat above the ground level; and curved sleeves with correspondingly curved legs such that the anti-tip support adjustably slides downward as it slides rearward to rest the foot on the ground.

4. The cooler/seat of claim 1, further comprising:

a pivoting connection between the sleeves and the bottom rear portion of the cooler/seat; and a ratchet rack and cogs arranged for holding the sleeve at an adjustable plurality of pivot angles.

5. The cooler/seat of claim 4, further comprising:

ratchet teeth that are cammed such that a simple downward push on the leg will ratchet the sleeve until the leg and foot touch the ground; and a spring biased ratchet release pushrod arranged such that a user can push the pushrod into the seat/cooler for releasing the ratchet to pivotingly raise the leg.

6. The cooler/seat of claim 1, further comprising:

a pivoting connection between the sleeves and the bottom rear portion of the cooler/seat; and a spring biased latch comprising a spring button which pops into selected pivot latch holes to allow selection of a desired sleeve pivot angle.

7. The cooler/seat of claim 1, further comprising:

a pivot knuckle in the leg with a spring biased latch therein such that the knuckle can be latched at a desired pivot angle for placing the foot on the ground.

* * * * *